United States Patent [19]

Kimura

[11] 4,384,714

[45] May 24, 1983

[54] WEIGHTED CUFF EXERCISING DEVICE

[76] Inventor: Akira Kimura, 1-25, Takenotsuka 3-chome, Adachi-ku, Tokyo, Japan

[21] Appl. No.: 249,597

[22] Filed: Apr. 1, 1981

[30] Foreign Application Priority Data

Dec. 29, 1980 [JP] Japan ..... 55-190039[U]

[51] Int. Cl.[3] ..... A63B 21/12

[52] U.S. Cl. ..... 272/119; 272/96

[58] Field of Search ..... 272/96, 67, 70, 119, 272/DIG. 4, 71, 143; 2/162, 170, 161 A, 160; 273/54 BA

[56] References Cited

U.S. PATENT DOCUMENTS 1,729,209 9/1929 Curtice ..... 272/96 X
3,124,806 3/1964 Campbell et al. ..... 2/160
3,278,184 10/1966 Rosenbaum ..... 272/96 X
3,629,867 12/1971 Taylor ..... 2/160
4,239,211 12/1980 Wilkerson ..... 272/119

*Primary Examiner*—Richard C. Pinkham
*Assistant Examiner*—William R. Browne
*Attorney, Agent, or Firm*—Lawrence I. Field

[57] ABSTRACT

A training has for drilling arm and foot muscles of a user includes a thick plate like main body made of soft and flexible material and having formed therein a plurality of elongated holes extending in a longitudinal direction, and a plurality of rods made of heavy metal and insertable into the holes of the main body. The main body has a substantially C-shaped configuration in a free condition. The training aid further has a pair of fastening tapes secured to the main body for detachably mounting the aid around the wrist and ankle of user.

1 Claim, 2 Drawing Figures

WEIGHTED CUFF EXERCISING DEVICE

BACKGROUND OF THE INVENTION

The present invention relates to a training aid for drilling arm and foot muscles, and more particularly a training aid which is detachably mounted around wrists and ankle of users.

Such a training aid is known and is commercially available. The known training aid comprises a bag made of canvas containing a number of small balls made of lead. Such a training aid is mounted around the wrist and ankle of a user and is fixed thereon by means of strings or bands. However, upon mounting when the bag is deformed circularly, there are formed wrinkles in an inner surface of the bag. Therefore, the user feels difficulty in using. Moreover when the user wears such a training aid directly around his wrist and ankle and moves hard and violently, the skin of wrist and ankle portions might be injured. Moreover the amount of balls in the bag which constitute a load for training cannot be changed and thus, it is impossible to adjust the load or weight in accordance with muscle power of the user. Therefore, the user must prepare a plurality of aids having different weights. Further, since the known training aid is fixed to the user only by the strings or bands, when the strings or bands are loosened or disconnected, the training aid might be accidentally removed from the user. This is sometimes very dangerous.

SUMMARY OF THE INVENTION

The present invention has for its object to provide a novel and useful training aid for drilling arm and foot muscles, which can be easily and firmly mounted around wrist and ankle of a user without causing any difficulty for the user.

It is another object of the invention to provide a training aid for arm and foot muscles, in which a load, i.e. a weight of the aid can be adjusted in a very simple manner.

According to the invention a training aid for drilling arm and foot muscles of a user comprises a main body consisting of a relatively thick plate made of soft and flexible material such as rubber and synthetic resin, the plate having a substantially C-shaped configuration including an opening in a free condition;

a plurality of elongated holes which are formed in the main body and extend in a longitudinal direction;

a plurality of rod like members made of heavy metal such as lead and iron and inserted in said hole; and fastening means secured to the main body for detachably mounting the training aid around wrist and ankle of the user.

In a preferred embodiment of the training aid according to the invention, said rod member has a diameter slightly larger than an inner diameter of said hole, and is resiliently inserted into the holes in a detachable manner.

DESCRIPTION OF THE PREFERRED EMBODIMENTS

Figure 1:
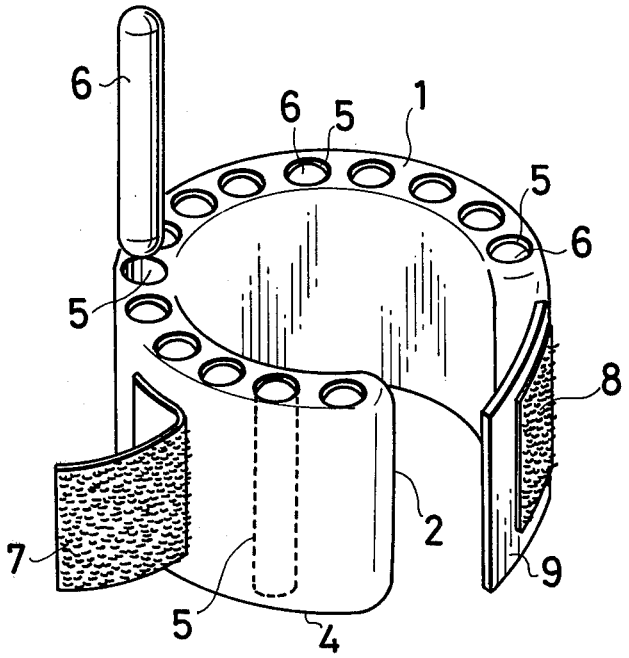
FIG. 1 is a perspective view illustrating an embodiment of the training aid according to the invention.

FIG. 1 shows an embodiment of the training aid according to the invention. The training aid comprises a main body 1 formed by a rectangular plate having a relatively large thickness and made of soft and flexible material such as rubber and synthetic resin. The main body 1 has a substantially C-shaped cross sectional configuration having an opening 2 in a free condition.

From an upper side surface 3 are formed a number of elongated holes 5 towards a lower side 4. The hole 5 has a circular cross section. The main body 1 can be simply formed by molding. Into the hole 5 is inserted a weight member 6 formed by a rod made of heavy metal such as lead. The rod 6 has a diameter which is slightly larger than an inner diameter of the hole 5 and thus, the rod 6 can be resiliently inserted into the hole 5 in a detachable manner. Therefore, the rod 6 is hardly removed out of the hole 5, even if the training aid is subjected to a hard movement.

Figure 2:
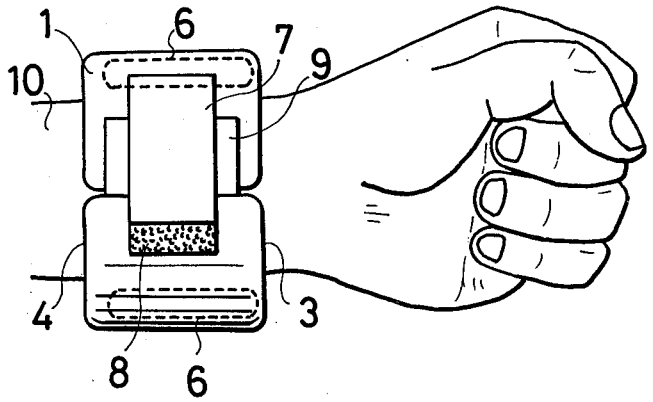
FIG. 2 shows the training aid of FIG. 1 mounted around a wrist of user.

In order to mount firmly the training aid around a wrist 10 of a user as shown in FIG. 2, the training aid further comprises a pair of fastening members 7 and 8. The member 7 is secured at its one end portion to the outer surface of the main body 1 near the opening 2 and the member 8 is wholly secured to a thin plate member 9 which is integrally formed with the main body 1. Since the weight rods 6 are inserted in a longitudinal direction of the main body 1, the main body 1 can be easily expanded or compressed in a radial direction. Upon mounting at first the main body 1 is expanded radially so as to widen the opening 2 through which the wrist 10 is passed and then the fastening members 7 and 8 are coupled with each other. In this case there is not formed any wrinkle in an inner surface of the main body 1, because it has been previously formed circularly. Further since the main body 1 is made of soft and flexible material, it can be mounted around the wrist 10 without forming a space there between. Thus the user could not feel difficulty in use and his skin cannot be injured under hard movement. Since the main body 1 is formed circularly, even if the fastening members 7 and 8 are disconnected, the main body 1 is hardly removed from the user.

In the embodiment shown in FIG. 1, since any desired number of rods 6 can be detachably inserted into the holes 5, the user can easily adjust the weight of the training aid in accordance with his muscle power.

The present invention is not limited to the embodiment explained above, but may be modified in various manners. For instance, the rods 6 may be fully embedded in the main body 1. In this case the weight of the aid cannot be changed. Further the rods 6 may be made of other heavy metals such as iron and alloys. The fastening means is not limited to the fasteners shown, but may be constituted by any of known fastening means. Further the training aid according to the invention can be mounted around the ankle of user for drilling the foot muscle of user.

What is claimed is:

1. A training aid for drilling arm and/or foot muscles of a user comprising:

a main body made of soft and flexible material in the form of a thick tubular member having a substantially C-shaped cross section in a free condition, major surfaces of said main body being smooth, said member being of substantially uniform thickness throughout its length;

a plurality of elongated holes formed in said main body and between the major surfaces, said holes extending in a longitudinal direction in said main body and being in parallel with each other, said holes extending substantially the full length of the member;

a plurality of rod like members each made of heavy metal and having a length substantially equal to the depth of said holes and a diameter which is slightly larger than the inner diameter of the hole said rod like members being detachably inserted in said holes; and fastening means secured to said main body for detachably mounting the training aid around wrist or ankle of the user.

* * * * *